US005983427A

United States Patent [19]

Igei

[11] Patent Number: 5,983,427

[45] Date of Patent: Nov. 16, 1999

[54] ADJUSTABLE PILLOW

[76] Inventor: Seishun Igei, Maruiso B-1, 36-11, Ganeko-Chome, Ginown, Okinawa, Japan

[21] Appl. No.: 08/989,349

[22] Filed: Dec. 12, 1997

[30] Foreign Application Priority Data

Dec. 19, 1996 [JP] Japan ..... 8-013538 U

[51] Int. Cl.[6] ..... A47G 9/00; A47C 20/00

[52] U.S. Cl. ..... 5/643; 5/640; 5/638

[58] Field of Search ..... 5/630, 638, 640, 5/643, 238, 244, 652.1, 657, 491, 935

[56] References Cited

U.S. PATENT DOCUMENTS

| | | | |
|---|---|---|---|
| Re. 12,952 | 5/1909 | Reich | 5/643 X |
| 2,239,003 | 4/1941 | Jones | 5/640 X |
| 5,353,457 | 10/1994 | Chu | 5/643 X |
| 5,522,793 | 4/1996 | Cohen | 5/657 X |

FOREIGN PATENT DOCUMENTS

| | | | |
|---|---|---|---|
| 1061219 | 8/1979 | Canada | 5/638 |

*Primary Examiner*—Michael F. Trettel
*Attorney, Agent, or Firm*—McGlew and Tuttle, P.C.

[57] ABSTRACT

An adjustable pillow, wherein through-holes 7 are formed at the both ends of a plurality of parallel support bars 6 constituting the head rest. Protrusion adjustment bolts 8 are inserted into these through-holes, and screwed into vertical female thread holes 4, 5 formed in a female thread hole unit section 2, 3 erected on both sides of a base 1. A blocking piece 9 carrying the support bar is attached to the protrusion adjustment bolt 8, at the lower surface of the support bar 6, for blocking the movement in the direction along the axis thereof. A substrate 12 is disposed under the base 1. Height adjustment bolts 14 are inserted into a plurality of through holes 13 formed in the substrate. On the upper side of this substrate, another blocking piece 15 is attached to the height adjustment bolt 14 for blocking its displacement of the substrate in the direction along the axis of the bolt 14 and so as to allow its rotation in respect to the substrate. Female thread holes 13 are formed on said base side for screwing and supporting each height adjustment bolt. Thus, the overall height of a pillow can be adjusted and set to the individual needs.

5 Claims, 4 Drawing Sheets

ADJUSTABLE PILLOW

FIELD OF THE INVENTION

The present invention relates to a pillow with structure appropriate for a sound sleep, wherein the shape and height of the head rest can be adjusted.

BACKGROUND OF THE INVENTION

Conventionally, various types of pillows have been proposed. For example, pillows for adjusting the height of head rest in respect to the substrate by using adjusting bolt, jack, link mechanism or the like are known. Pillows allowing a desired shape of head rest surface by choosing holes of any height and introducing respectively both ends of a plurality of metal bars into side plates having a number of holes and disposed with a certain interval or the like have been proposed.

However, as the adjustment is made on the side, the conventional height adjustment is unattractive and its structure exposes the pillow side.

SUMMARY OF THE INVENTION

Therefore, the object of the present invention is to permit the user to easily adjust the shape of the head rest and, moreover, to adjust the height according to the head shape of the individual, or according to one's liking.

The present invention concerns an adjustable pillow, wherein the head rest is composed of a plurality of parallel support bars laid transversely. Protrusion adjusting bolts are inserted into vertical through-holes formed at both ends of these respective support bars. The extremity of these bolts is screwed into vertical female thread holes formed in a female thread hole unit section erected on both sides of a base. A blocking piece carrying the support bar is attached to the protrusion adjusting bolt, at the lower surface of the support bar, for blocking the movement to the direction along the axis of the protrusion adjusting bolt.

Therefore, in use, when a respective protrusion adjusting bolt is moved vertically and individually with respect to the female unit by turning the protrusion adjusting bolt of both ends, a plurality of support bars constituting the head rest carried by the blocking piece move also vertically with the protrusion adjusting bolt. The height can be adjusted for each support bar, and the height of respective support bars can be set according to the head shape or liking of the individual. In consequence, a pillow having a head rest of the shape comfortable and appropriate for a sound sleep can be realized.

The present invention concerns also a height adjustable pillow wherein, a substrate is disposed under the base. Height adjusting bolts are inserted into a plurality of through holes formed in this substrate. Heads of these height adjustment bolts are exposed rotatably from under this substrate, while on the upper side of this substrate, a blocking means is attached to the height adjustment bolt for blocking its displacement in the direction along the axis of the height adjustment bolt and allowing its rotation with respect to the substrate. Female thread holes are formed on said base side for screwing and supporting respective adjusting bolts.

In this composition, the overall height of the pillow can be adjusted and set to the individual needs, by turning the height adjustment bolts inserted into and supported on the substrate side, providing a pillow adjustable in height, easy to use and appropriate for a sound sleep.

DETAILED DESCRIPTION OF THE PREFERRED EMBODIMENTS

Figure 1:
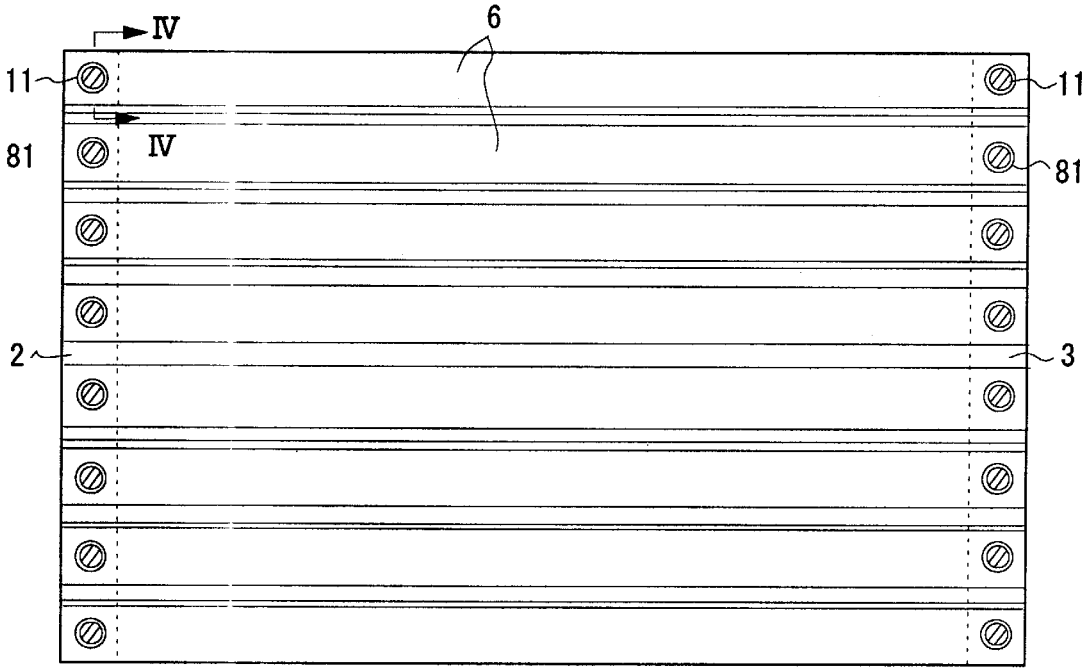
FIG. 1 is a plan view of an embodiment of the pillow according to the present invention.
Figure 2:
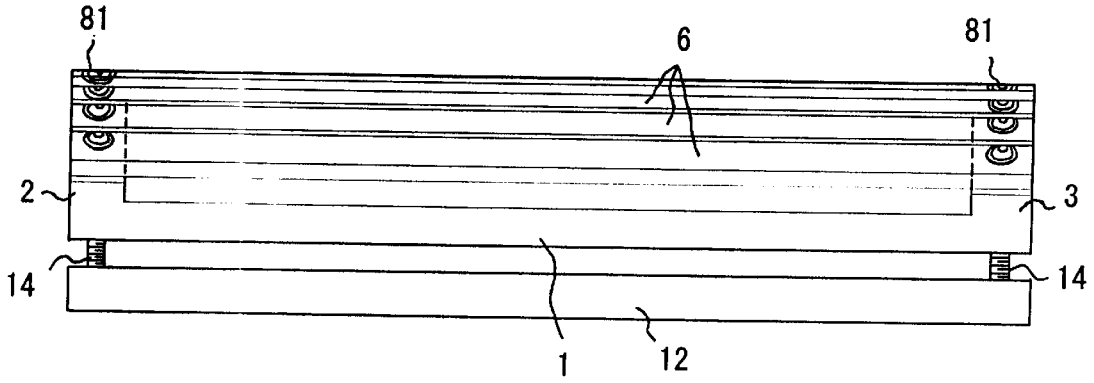
FIG. 2 is a front view of FIG. 1.
Figure 3:
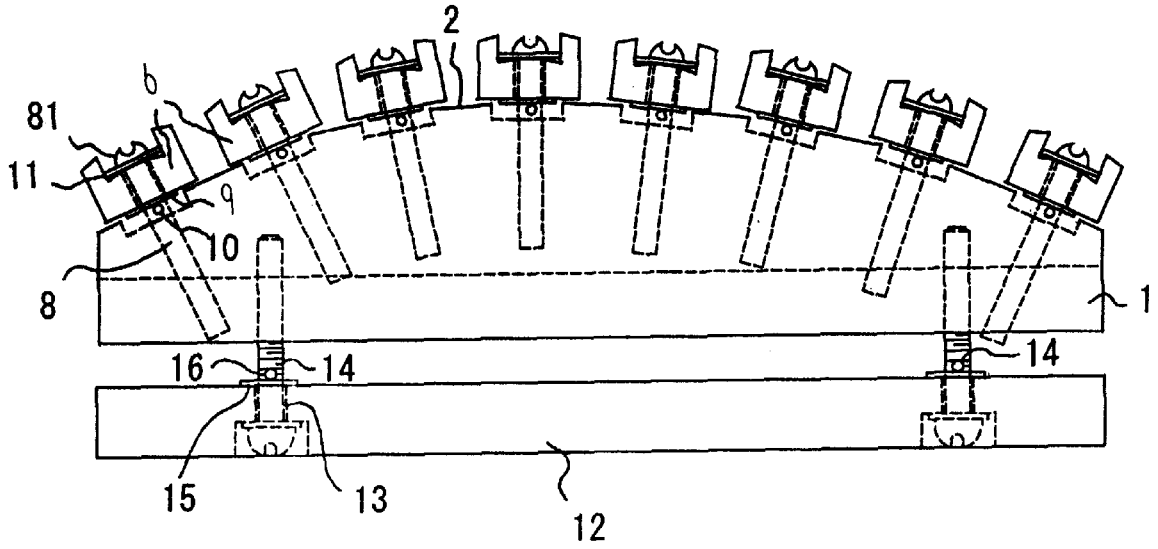
FIG. 3 is a left side view of FIG. 1.

Now the present invention will be described in reference to the embodiment as shown in the drawings.

FIG. 1 to FIG. 4 illustrate an embodiment of the pillow according to the present invention.

1 designates base and female screw side units 2, 3 are erected on the right and left sides thereof. Female screw side units 2, 3 describe an arc upward in the illustrated example and, moreover, a plurality of female thread holes 4, 5 are perforated radically. Note that, here, the upper surface of the female screw unit 2,3 may be a plane s hape or an arc shape downward.

Figure 4:
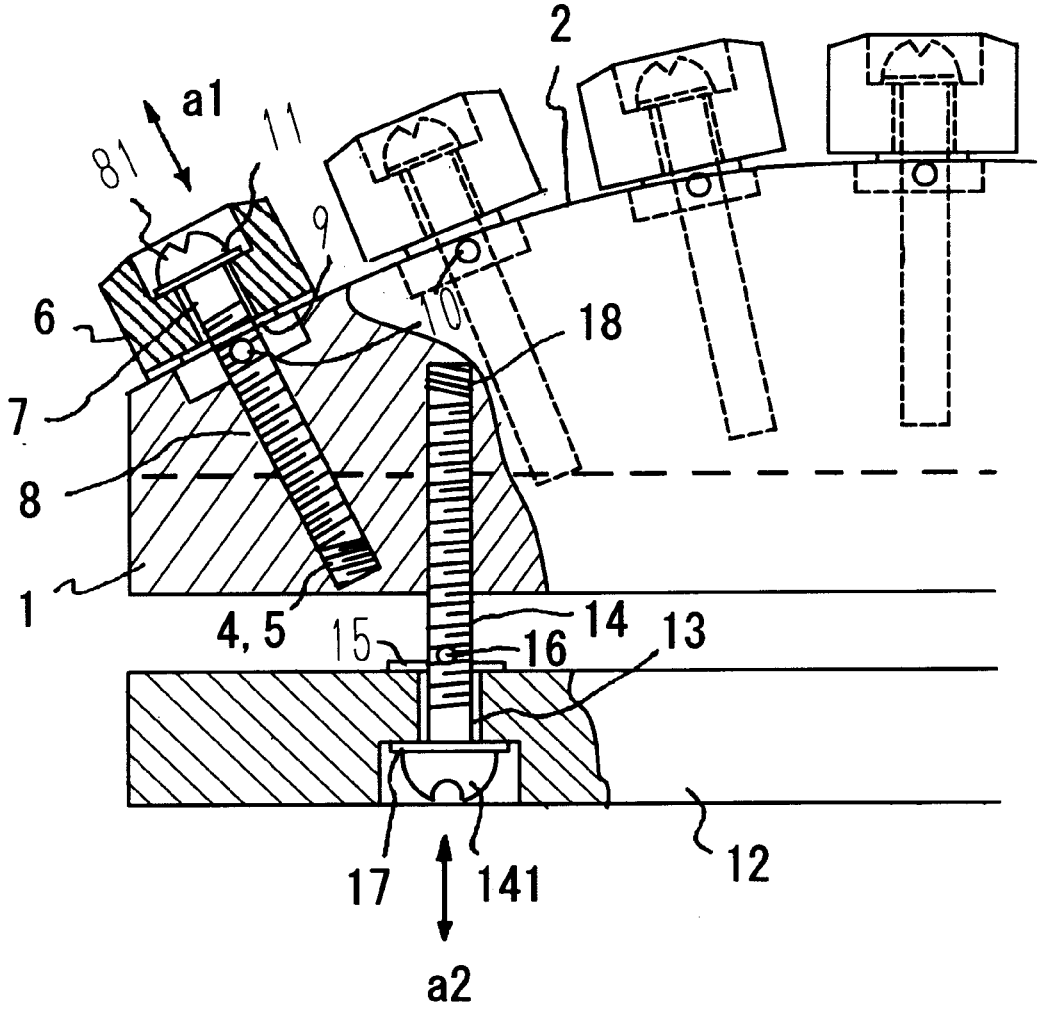
FIG. 4 is an enlarged side view along the cross-section of the position IV—IV in FIG. 1.

A plurality of support bars 6 are laid over right and left female screw units 2, 3. As shown in FIG. 4, a through-hole 7 is perforated vertically at the both ends of respective support bars 6 and a protrusion adjusting bolt 8 is introduced therein.

A recess may be formed advantageously at the upper section of the hole so that the head 81 of this protrusion adjusting bolt 8 may be buried in the through-hole and, as a result, the head rest surface becomes a plane. On the protrusion adjusting bolt 8, in order to permit holding of the support bar 6, a washer 9 is disposed at the lower surface of the support bar 6 and fixed by introducing a pin 10 through a traverse hole perforated in the protrusion adjusting bolt 8 in a way to block displacement along the axis. In consequence, the protrusion adjusting bolt 8 may rotate freely in respect of the washer 9 and the support bar 6, while the washer 9 can not move in the direction (shown by the arrow A1) parallel to its axis. Here, 11 designates a head side washer. The protrusion adjusting bolts 8 attached to the respective support bar 6 are introduced and screwed into the female thread holes 4, 5 which are perforated in the female screw units 2, 3.

In this composition, the height of the support bar 6 carried by the washer 9 can be adjusted freely by adjusting through the rotation of the protrusion adjusting bolt 8 disposed at the both ends of the desired support bar 6. Moreover, as one can adjust the protrusion by fitting a driver into the head 81 of the protrusion adjusting bolt 8 and turning the driver with one's head laid on the support bars 6, one can adjust the pillow according to their head shape. Thus it is unnecessary to adjust and confirm repeatedly.

The protrusion adjusting bolt 8 is not necessarily provided on all support bars 6, but it may disposed on the minimum necessary support bars. Moreover, as. necessary, lump shaped protuberances may be disposed at the convenient points over the upper surface of all or desired support bars, to stimulate effectively the cardinal points of the head or the scruff of the neck.

The present invention is able to adjust the whole height of the pillow in addition to the protrusion adjustment of each support bar 6.

In other words, a substrate 12 is provided under the base 1, abd through-holes 13 are perforated in front and rear, right and left sides thereof. A height adjustment bolt 14 is introduced into the substrate 12 from an underside, and four female thread holes 18, corresponding to the bolt insertion hole 13 of the substrate 12, are perforated on the base 1. The height adjustment bolt 14 is made to be introduced from underside and screwed into this female thread hole 18.

As shown in FIG. 4, the head 141 of the height adjustment bolt 14 is exposed rotatably from underside of the substrate 12. On the upper side of said substrate, a washer 15 is supported by a pin 16 introduced into a traverse hole perforated into the height adjustment bolt 14, as a means for blocking the displacement of the height adjustment bolt 14 in the direction (shown by the arrow $A_2$) of the bolt axis while allowing rotation of the bolt 14 with in respect to the substrate 12. Here, 17 designates a washer at the head side.

In consequence, the height of the whole pillow can be adjusted by fitting a driver into the head 141 of respective height adjustment bolt 14 and turning the same to raise the base in respect to the substrate 12 pinched by the height adjustment bolt 14 and the washer 15.

On the other hand, the through-hole 13 of the substrate 12 can be formed relatively larger to allow to slant the height adjustment bolt 14 in respect to the through-hole 13 so that the forward and backward inclination of the whole pillow may be adjusted by changing the height respectively of the height adjustment bolt 14 in the front and rear of the base.

The material may be selected arbitrarily for the base 1, the female screw unit 2, 3, the support bar 6, the substrate 12 or other parts of the pillow of the present invention and members for forming the female screw. Female screw units 2, 3, may also be realized by burying and fixing a nut or the like, in place of the female thread hole.

The forms of respective members are also selected arbitrarily and, for example, the cross-section forms of respective support bars 6 or the like may be circular, polygonal other than rectangular, or other various shapes.

According to the present invention, the head rest can take any form according to the head shape or the liking of individuals, as respective protrusion adjustment bolts move vertically in respect of the female screw unit to be adjusted for each support bar by turning the protrusion adjusting bolt at the both ends of a plurality of support bars, to realize a pillow comfortable and appropriate for a sound sleep.

Moreover, as the whole height or the inclination of the pillow can be adjusted and set freely according to one's needs, by turning the height adjustment bolt inserted into and supported with the base side, a pillow is formed that is easy to use and appropriate for a sound sleep.

What is claimed is:

1. An adjustable pillow comprising:

a base;

female thread hole units erected on both sides of said base;

a plurality of parallel support bars laid transversely with vertical through-holes formed at both ends of respective said support bars;

protrusion adjusting bolts inserted into said through-holes, and screwed into vertical female thread holes formed in said female thread hole unit section;

blocking pieces carrying the support bars are attached to each said protrusion adjusting bolt at a lower surface of the support bar, so as to block the movement in a direction along an axis of the protrusion adjusting bolt;

each of said bolts including a bolt head rotatable from an upper side of said support bar.

2. The adjustable pillow according to claim 1, wherein a substrate is disposed under the base;

height adjusting bolts are inserted into a plurality of through holes formed in the substrate, heads of the height adjustment bolts are exposed and rotatable from the lower side of the substrate, a blocking means is positioned and attached to the height adjustment bolts for blocking displacement of said substrate in a direction along an axis of said height adjustment bolt and to allow rotation of the height adjustment bolt with respect to the substrate;

female thread holes are formed on said base for screwing and supporting each said height adjustment bolt.

3. An adjustable pillow comprising:

first and second side units defining a plurality of threaded holes;

a plurality of substantially parallel support bars, each of said support bars defining a through hole at ends of said each support bar;

a plurality of protrusion adjusting bolts, each of said protrusion adjusting bolts being inserted into one of said through holes and threaded into one of said plurality of threaded holes, said each protrusion adjusting bolt including a bolt head rotatable in said respective support bar;

a blocking piece attached to each said protrusion adjusting bolt adjacent a respective said support bar for blocking movement of said respective support bar along an axis of a respective said protrusion adjusting bolt.

4. A pillow in accordance with claim 3, wherein:

said plurality of support bars are laid transversely to said side units;

a base connects said first and second side units;

said blocking piece is adjacent a lower surface of said respective support bar;

said bolt head is rotatable from an upper side of said respective said support bar.

5. A pillow in accordance with claim 3, wherein:

a base connects said first and second side units, said base defines a plurality of threaded holes;

a substrate is positioned adjacent said base, said substrate defines a plurality of through holes;

a plurality of height adjustment bolts are positioned rotatable in said through holes of said substrate and are threaded into said threaded holes of said base, said height adjustment bolts have heads rotatable in said substrate and exposed on a lower side of said substrate;

blocking means connected to said height adjustment bolts for blocking displacement of said substrate along an axis of a respective said height adjustment bolt.

* * * * *